United States Patent [19]

Tibbitts

[11] Patent Number: 4,981,183

[45] Date of Patent: Jan. 1, 1991

[54] APPARATUS FOR TAKING CORE SAMPLES

[75] Inventor: Gordon A. Tibbitts, Salt Lake City, Utah

[73] Assignee: Baker Hughes Incorporated, Houston, Tex.

[21] Appl. No.: 215,500

[22] Filed: Jul. 6, 1988

[51] Int. Cl.[5] ..... E21B 10/02; E21B 10/48

[52] U.S. Cl. ..... 175/244; 175/330; 175/403

[58] Field of Search ..... 175/330, 244–255, 175/403, 404

[56] References Cited

U.S. PATENT DOCUMENTS

| | | | |
|---|---|---|---|
| 1,994,848 | 3/1935 | Baker et al. | 175/244 |
| 2,373,323 | 4/1945 | Macready | 175/245 X |
| 2,747,841 | 5/1956 | Adamson et al. | 175/250 |
| 2,842,343 | 7/1958 | Church et al. | 175/248 |
| 2,880,969 | 4/1959 | Williams | 175/245 X |
| 3,692,126 | 9/1972 | Rushing et al. | 175/246 X |
| 4,606,416 | 8/1986 | Knighton et al. | 175/250 X |

*Primary Examiner*—Stephen J. Novosad

*Attorney, Agent, or Firm*—Arnold, White & Durkee

[57] ABSTRACT

A coring apparatus which includes a drill bit and a receiving member. The drill bit includes discrete cutting elements for cutting the outer dimension of the core. The receiving member is adapted to lie proximate to the discrete cutting surfaces and to receive the core as it leaves the cutting surfaces. Additionally, drilling fluid is directed away from the cut core.

15 Claims, 2 Drawing Sheets

FIG. 1
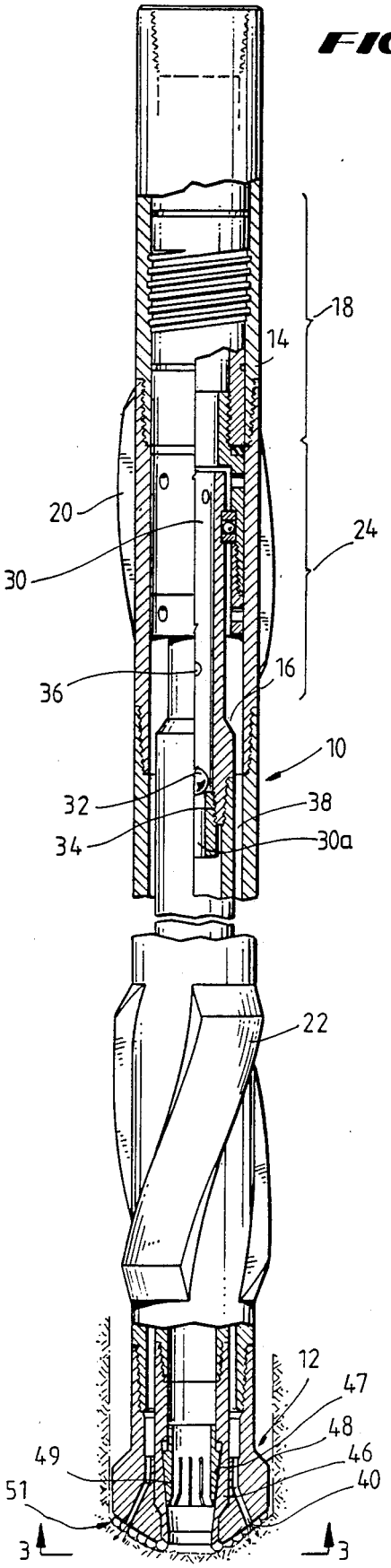
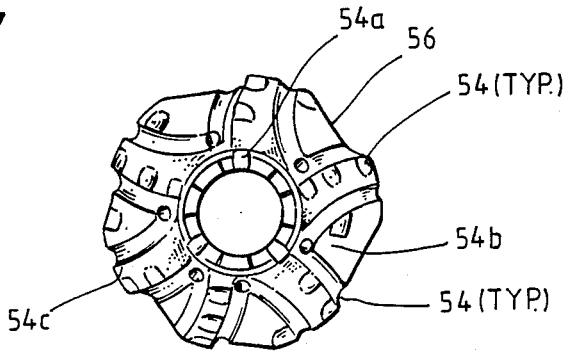
FIG. 3
FIG. 2
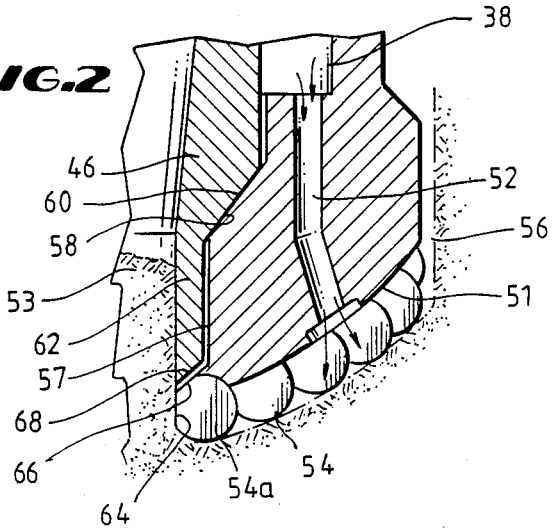
FIG. 4
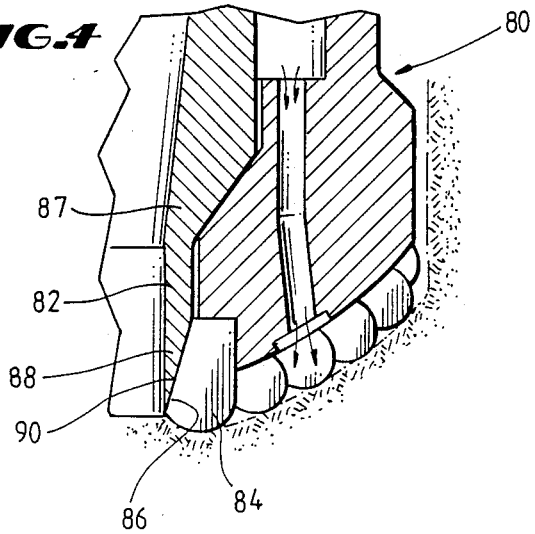

APPARATUS FOR TAKING CORE SAMPLES

BACKGROUND OF THE INVENTION

The present invention relates generally to methods and apparatus for taking core samples, and more specifically relates to new and improved methods and apparatus to cut cores and to retain the cores while minimizing breakup or fluid deterioration of the cores.

Formation coring is a well-known process in the oil and gas industry. In conventional coring operations, a coring bit, adapted to cut a cylindrical core from the formation, is coupled to a core barrel assembly adapted to receive and retain the core. As the core is cut, it will traverse an inner gage-cutting portion of the bit to eventually reach a core shoe which accepts the core and guides it into an inner retention tube.

Some significant problems are encountered when coring is performed in relatively soft to medium hard, or unconsolidated formations. Since many hydrocarbon producing formations, such as sands and limestones, are in this latter category, this is a matter of major concern. Conventional coring bits typically utilize relatively large, discrete, cutters which serve to cut the formation efficiently. Such conventional bits include cutters distributed from proximate the inner gage of the bit, along the bit contour, to the outer gage. The bits typically include both inner and outer gage cutting sections formed of vertical rows of surface-set natural diamonds. Additionally, these core bits typically provide for discharging drilling fluid adjacent the core to lubricate these inner gage cutting portions.

The disadvantages of these conventional systems are substantial. For example, the abrasive cutting of the surface-set diamonds on the inner gage of the bit puts substantial strain on the relatively fragile core produced from a soft to medium hard formation, promoting breakage of the core. Such core breakage, in addition to being damaging to the core, and thereby to its value as a formation indicator, will also frequently cause core jamming in the core barrel, leading to a premature and undesired end to the coring operation. Additionally, and critically, the fluid discharge required for lubrication of the gage cutting section promotes fluid invasion of a fractured or permeable core, again promoting deterioration of the core, both structurally and, most importantly, as a formation sample. This fluid invasion of the core is a major problem and may be especially severe with particular types of drilling fluids.

Accordingly, the present invention provides a new method and apparatus for coring a formation whereby the exposure of the core to drilling fluids may be minimized, to prevent the core from fluid invasion, and whereby the core may be immediately inserted into the core shoe after cutting to minimize mechanical strains and fluid exposure on the core.

SUMMARY OF THE INVENTION

A coring apparatus in accordance with the present invention includes a coring bit which is adapted to cut the formation and to form a core, and a receiving member which is adapted to receive the core, essentially as the core is cut. In a particularly preferred embodiment, the drill bit includes discrete cutters, such as PDC or mosaic-type cutters, which form a cutting surface adapted to cut the exterior diameter of the core. The receiving member includes an entry or pilot section which extends to a position proximate the cutting surface, so as to receive the core generally immediately after it traverses the dimension of the cutting surface.

In a particularly preferred embodiment, the gage cutters and the pilot section will be cooperatively conformed such that the pilot section extends longitudinally beneath the upper extent, or dimension, of the gage cutters. Also in a particularly preferred embodiment of the invention, the coring apparatus is conformed such that drilling fluid will be discharged through the face of the coring bit, rather than adjacent to the cut core. An advantageous implementation of this particularly preferred embodiment includes a coring bit with a generally parabolic profile which serves to enhance the movement of cuttings and fluid from the bottom of the hole, and thereby away from the formation core.

BRIEF DESCRIPTION OF THE DRAWINGS

FIG. 1 depicts an exemplary embodiment of a core barrel in accordance with the present invention, illustrated partially in vertical section.

FIG. 2 depicts a portion of the coring bit and coring shoe of the core barrel of FIG. 1, illustrated in vertical section.

FIG. 3 depicts the core bit and core shoe of FIG. 1 from a lower plan view.

FIG. 4 depicts an alternative embodiment of a core bit and core shoe for use in accordance with the present invention.

DETAILED DESCRIPTION OF A PREFERRED EMBODIMENT

Figure 5:
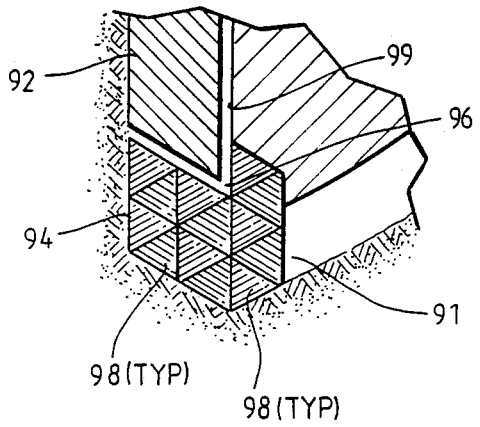
FIG. 5 depicts an exemplary alternative configuration for a core shoe/cutter assembly in accordance with the present invention, depicted partially in vertical section.

Referring now to FIG. 1 of the drawings, therein is depicted a core barrel assembly 10 in accordance with the present invention. Core barrel assembly 10 includes a core shoe/bit assembly, indicated generally at 12. Much of core barrel assembly 10 functions in a conventional manner. Briefly, core barrel assembly 10 includes an outer tube or housing assembly 14 and an inner tube assembly 16. Outer tube assembly 14 is coupled to the drill string (not illustrated), by a safety joint assembly, indicated generally at 18. Outer tube assembly 14 preferably includes stabilizers 20 and 22 on its exterior to stabilize core barrel 10 and to prevent bit wobble. Inner tube assembly 16 is rotatably coupled relative to outer tube assembly 14 by a swivel assembly 24.

Core barrel assembly 10 includes provisions for flushing and cleaning of the bottom of the hole prior to coring. Specifically, inner tube assembly 16 includes a fluid passageway 30. Passageway 30 is closable by means of a drop ball 32 adapted to cooperate with a ball seat 34. Landing of ball 32 on seat 34 will close a lower portion 30*a* of passageway 30 and cause fluid to pass through apertures 36 in inner tube assembly 16 and to pass through annulus 38 to exit through discharge apertures 40 in coring bit 48. Thus, prior to the landing of ball 32, fluid can be circulated down through passageway 30 and up around the exterior of core barrel assembly 10. The landing of ball 32 diverts the fluid flow, as described above, and readies the assembly for coring.

Core shoe/bit assembly 12 is located at the bottom end of core barrel 10, and includes core shoe 46 and core bit 48. Core shoe 46 is coupled at the lower end of inner tube assembly 16. Core bit 48 is coupled at the lower end of outer tube assembly 14, for rotation therewith. Core shoe 46 includes a tapered recess 47 which houses a retention ring 49. Retention ring 49 is a conventional member which is adapted to move longitudinally in tapered recess 47, and which includes a plurality of surfaces adapted to grip a core and to retain it as ring 49 moves downwardly in core barrel assembly 10, most commonly known as a slip type core catcher.

Referring now also to FIGS. 2 and 3, in each Figure are depicted portions of coring shoe 46 and core bit 48 in greater detail. Those skilled in the art will recognize that core bit 48 can be one of a variety of shapes. Core bit 48 preferably includes a body member having a generally parabolic outer profile, indicated generally at 51. Alternatively, other profiles can be utilized to advantage. As an example, generally flat sides, giving the bit a generally conical form may be utilized. Core bit 48 includes a plurality of passageways 52 which provide fluid communication between annulus 38 and discharge apertures 40 in the face of bit 48. A plurality of cutters 54 are preferably distributed along the profile of bit 48. Cutters 54 are preferably polycrystalline diamond compact (PDC) cutters, or large thermally stable synthetic diamond product (TSP) cutters which are available in similar sizes and shapes to PDC's, or mosaic-type cutters comprising smaller thermally stable synthetic diamond products (TSP's) arranged in a pattern to simulate a larger, unitary cutter; and may be distributed in any suitable arrangement across body member 56 of bit 48.

Body member 56 preferably includes a lower bore 57. At least one cutter 54*a*, and preferably two or three such cutters, 54*b*, 54*c* extend inwardly of the surface defining bore 57 of core bit 48 to cut an inside gage, i.e., the external diameter of the core 53. Cutters 54*a–c* may be secured to body member 56 by conventional means, such as being bonded into a matrix or mounted through use of studs. Each individual gage cutting element 54*a*, 54*b*, 54*c* is preferably formed with a flat 64 at this gage dimension. This flat 64 assures that as cutting elements 54*a–c* start to wear, the gage of the core will be cut to a uniform dimension. Thus, the interior gage of bit 48 (the exterior gage of the core), as established by flats 64, is offset from the dimension of the surface 57. This allows bit 48 to accommodate an annular lip or pilot section 62 of core shoe 46 within the dimension provided by cutters 54*a*, 54*b*, 54*c* between flats 64 and surface 57.

In the depicted preferred embodiment, core bit 48 includes a shelf 58 on its inner surface. Shelf 58 is disposed at an angle to the axis of bit 48. Core shoe 46 includes a bearing surface 60 which is preferably adapted to contact shelf 58 and to thereby form a fluid restriction, or, ideally, a fluid seal between the rotating bit and the stationary core barrel. Pilot section 62 extends downwardly from bearing surface 60 and is adapted to lie proximate gage cutters 54*a–c*. In the embodiment of FIGS. 1–3, gage cutters 54*a–c* have an angled flat 66 formed on their upper half. Pilot section 62 extends with a complementary angled surface 68 to lie proximate flat 66. Pilot section surface 68 will preferably lie within approximately 0.5 inch of flat 66, and most preferably will lie within approximately 0.050 inch to 0.010 inch of flats 66. As can be seen in FIG. 2, the engagement of pilot section bearing surface 60 with shelf 58 serves to limit travel of pilot section 60 to maintain the desired stand-off between surface 68 and flats 66 on cutters 54*a–c*. Although parallel flat surfaces 66 and 68 are shown in gage cutter 54*a* and pilot section 62, respectively, other generally complimentary surfaces may be utilized, such as generally concentric curvilinear surfaces, etc.

In operation, as depicted in FIG. 2, core shoe/bit assembly 12 provides substantial functional advantages over prior art systems. As bit 48 is rotated within the formation, cutters 54 will cut the formation, and cutters 54*a–c* will cut the exterior gage of the core. As the core is cut, it immediately and directly enters core shoe 46. Accordingly, there is no additional gage cutting section which exerts mechanical stress on the core. Additionally, because there is no extensive gage cutting section, there is not a need for fluid adjacent the cut core. This, very importantly, substantially prevents fluid invasion of the core. As previously described, surfaces 58 and 60 (of bit 48 and core shoe 46, respectively), cooperatively form a fluid restriction, or preferably a fluid seal. Accordingly, drilling fluid is directed from annulus 38 through passages 52 to face discharge apertures 40. Thus, the fluid is not discharged proximate the core, as is typical of conventional systems. Additionally, the relatively steep parabolic profile of bit 48 facilitates both improved flushing of cuttings away from the bit and improved movement of cutting fluid away from where the core is being formed from the virgin formation. The cut core is thus protected from fluid invasion by both avoiding the directing of an appreciable amount of drilling fluid past the cut core, and by directing the fluid primarily away from the core as it is cut.

As previously described, core barrel assembly 10 is a mechanically-actuable assembly, adapted to retain a core by mechanically gripping the exterior of the core. It should be understood that the present invention may also be utilized with other types of core barrel assemblies, including hydraulically-actuable and/or full closure core barrels, as disclosed in U.S. Pat. Nos. 4,552,229, to Radford et al., and 4,553,613, also to Radford et al. Each of these patents is assigned to the assignee of the present invention. The specifications of U.S. Pat. Nos. 4,552,229 and 4,553,613 are incorporated herein by reference for all purposes.

Referring now to FIG. 4, therein is depicted a representative portion of an alternative embodiment of a core shoe/bit assembly 80. Core shoe/bit assembly 80 functions very similarly to core shoe/bit assembly 12, accordingly only the essential differences in structure will be discussed herein. Core shoe/bit assembly 80 is representative of one of a variety of assemblies which may be designed and utilized. Each gage cutter 84 of core shoe/bit assembly 80 is conformed to include a tapered area with a long flat 86 on its inner surface. Flats 86 are angularly disposed relative to the longitudinal axis of the core barrel assembly. A pilot section 82 of core shoe 87 is cooperatively conformed with a tapered portion 88, having a surface 90 adapted to lie generally proximate and parallel to surface 86 of cutter 84. Thus, in this embodiment, core shoe 87 extends not only within a dimension established by gage cutter(s) 84, but also extends longitudinally for a significant distance beneath the upper dimension (or surface) 88 of cutter(s) 84. Gage cutter 84 may be again formed of a PDC, large TSP, mosaic or similar material adapted to provide the desired shape.

Referring now to FIGS. 5–8, therein are depicted exemplary cutter constructions and core shoe/cutter relationships which may be utilized in accordance with the present invention. FIG. 5 depicts a cutter assembly 91 and the pilot portion of a core shoe 92. Cutter assembly 91 is a composite mosaic cutter formed of a plurality of discrete thermally stable diamond cutting elements 98, bonded together to effectively form a single cutting element. As with previous embodiments, cutter assembly 91 includes a generally flat interior surface 94 to cut the exterior gage of the core. Cutter assembly 91 includes an upper "notch" 96 to receive tip 98 of core shoe 92 having its lowermost dimension adjacent sidewall 99 of the bit.

Figure 6:
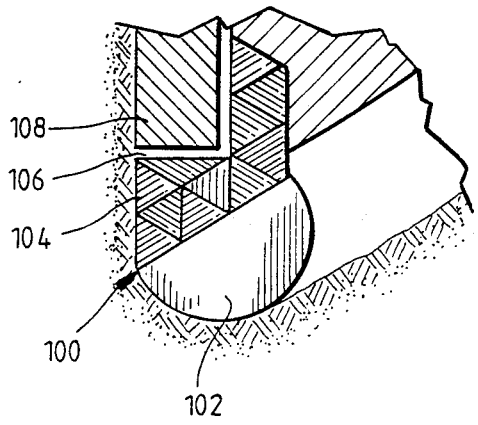
FIG. 6 depicts an exemplary alternative configuration for a core shoe/cutter assembly in accordance with the present invention, depicted partially in vertical section.

FIG. 6 depicts a cutter assembly 100 which includes a polycrystalline diamond cutter 102 and a mosaic cutter assembly portion 104. Polycrystalline diamond cutter 102 may be a conventional "half-round" shape or other portion of a hemispherical section. Mosaic cutting section 104 extends generally vertically, again to cut the gage of a core, and forms a generally L-shaped shelf 106 to receive lower end of core shoe 108. Alternatively, one or more thermally stable diamond disc cutters could be coupled to a mosaic cutting section.

Figure 7:
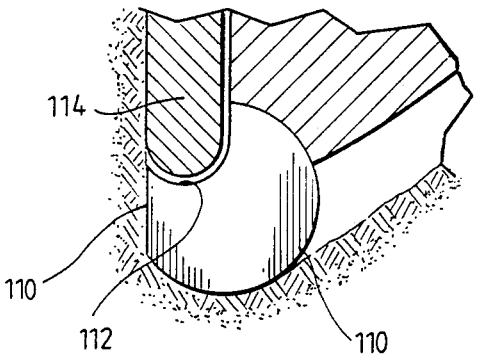
FIG. 7 depicts an exemplary alternative configuration for a core shoe/cutter assembly in accordance with the present invention, depicted partially in vertical section.

FIG. 7 depicts a PDC-type cutter, such as, for example, a half-inch or larger PDC cutter 110 which includes a curvilinear, or generally J-shaped, notch 112 adapted to receive the rounded tip 114 of a core shoe. Cutter 110 again includes a flat 116 adjacent notch 112.

Figure 8:
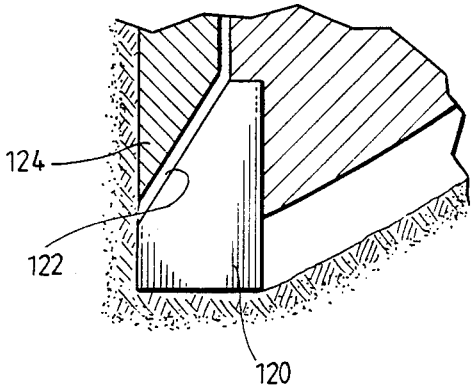
FIG. 8 depicts an exemplary alternative configuration for a core shoe/cutter assembly in accordance with the present invention, depicted partially in vertical section.

FIG. 8 depicts a PDC-type cutter 120 which is generally rectangular in shape, with the exception of having an upper interior corner "cropped" to form an angled surface 122 adapted to cooperatively accommodate a tip 124 of the core shoe.

As can be seen in each of the embodiments of FIGS. 5–8, the pilot section of the core shoe is preferably received within the dimension established by the gage cutters between the interior cutting surface of the cutter (preferably a flat), and the sidewall of the adjacent portion of the core bit. With each of the embodiments of FIGS. 5–8, the clearances between the core shoe and the gage cutters will preferably be similar to those described earlier herein, i.e., preferably less than 0.5 inch, and most preferably, 0.050 to 0.010 inch.

Many modifications and variations may be made in the techniques and structures described and illustrated herein without departing from the spirit and scope of the present invention. For example, as noted previously, hydraulically operated and/or full closure core barrel assemblies may be utilized to retain the cores. Additionally, and also by way of example only, many different types of cutter types and configurations may be utilized on coring bits for use with the present invention. Also, as can be seen from the depicted configurations and constructions of cutters and core shoes a virtually endless variety of geometric configurations of cutters and cooperative forms of core shoes may be utilized in accordance with the present invention. As discussed herein, the cutters may be relatively large discrete cutting elements, may be composite cutting elements, or may be combinations of both types. Accordingly, it should be readily understood that the described embodiments are illustrative only, and are not to be considered as limitations upon the scope of the present invention.

What is claimed is:

1. A core apparatus for taking formation cores, comprising:
   - a coring bit having at least one discrete cutter adapted to cut the exterior dimension of a core; and
   - a receiving member adapted to receive said core as the core is cut, said receiving member and said discrete cutter of said bit, cooperatively conformed to be positioned immediately adjacent one another as said core is cut.

2. The coring apparatus of claim 1, wherein said receiving member and said discrete cutter of said bit are positioned within approximately 0.050 inches of one another as the core is cut.

3. The coring apparatus of claim 1, wherein said receiving member and said discrete cutter lie within approximately 0.10 inches of one another as the core is cut.

4. The coring apparatus of claim 1, wherein said discrete cutter has, at least initially, a partially curvilinear cutting surface.

5. The coring apparatus of claim 1, wherein said discrete cutter includes a tapered section with a surface angularly disposed relative to the longitudinal axis of said receiving member, and wherein said receiving member has a tapered surface adapted to lie proximate said angularly disposed surface of said discrete cutter as said core is cut.

6. The coring apparatus of claim 1, wherein said discrete cutter comprises a polycrystalline diamond cutting surface.

7. The coring apparatus of claim 1, wherein said discrete cutter comprises a thermally stable synthetic diamond surface.

8. A coring apparatus for taking formation cores, for use with a drill string, comprising:
   - an outer assembly adapted to couple to said drill string;
   - a coring bit having a body member adapted to couple to said drill string, said bit including a plurality of discrete cutting surfaces secured to said body member and adapted to cut the exterior gage of a core, said cutting surfaces extending inwardly of said bit body member; and
   - a receiving assembly adapted to receive said core as it is cut, said receiving assembly including a pilot section which extends, at least partially, into the dimension between the interior bore of said body member and the innermost dimension of said gage-cutting cutting elements.

9. The coring apparatus of claim 8, wherein said pilot section extends longitudinally to a position proximate at least the uppermost dimension of said gage cutting elements.

10. The coring apparatus of claim 8, wherein said coring bit comprises drilling fluid discharge apertures positioned in the face of the bit.

11. The coring apparatus of claim 8, wherein said coring bit and said receiving assembly are cooperatively formed to establish a restriction to fluid flow proximate said discrete cutting surfaces cutting the outer gage of said core.

12. A coring apparatus for taking formation cores, comprising:

a coring bit having at least one discrete generally planar cutter adapted to cut the exterior dimension of a core; and a receiving member adapted to receive said core as the core is cut, said receiving member and said discrete cutter cooperatively conformed to be positioned proximate approximately 0.100 inch of one another as said core is cut.

13. The coring apparatus of claim 12, wherein said receiving member and said discrete cutter of said bit are positioned within approximately 0.050 inches of one another as the core is cut.

14. The coring apparatus of claim 12, wherein said discrete cutter has a generally curvilinear cutting surface.

15. The coring apparatus of claim 12, wherein said discrete cutter includes a tapered section with a surface angularly disposed relative to the longitudinal axis of said receiving member, and wherein said receiving member has a tapered surface adapted to lie proximate said angularly disposed surface of said discrete cutter as said core is cut.

* * * * *